US005787902A

United States Patent [19]

Shepherd et al.

[11] Patent Number: 5,787,902

[45] Date of Patent: Aug. 4, 1998

[54] CONCENTRIC CORE FILTER

[75] Inventors: Richard Karl James Shepherd, Somerset; John Charlton, Washington; Paul Francis Clarke, Tyne and Wear, all of United Kingdom

[73] Assignee: Cigarette Components Limited, London, United Kingdom

[21] Appl. No.: 793,980

[22] PCT Filed: Aug. 18, 1995

[86] PCT No.: PCT/GB95/01961

§ 371 Date: Feb. 18, 1997

§ 102(e) Date: Feb. 18, 1997

[87] PCT Pub. No.: WO96/05743

PCT Pub. Date: Feb. 29, 1996

[30] Foreign Application Priority Data

Aug. 19, 1994 [GB] United Kingdom ..... 9416812

[51] Int. Cl.[6] ..... A24B 15/00

[52] U.S. Cl. ..... 131/331; 131/344

[58] Field of Search ..... 131/331, 334, 131/359, 364, 361, 341, 344

[56] References Cited

U.S. PATENT DOCUMENTS

| | | | |
|---|---|---|---|
| 4,064,791 | 12/1977 | Berger | 131/261 R |
| 4,301,816 | 11/1981 | Wahle et al. | 131/88 |
| 5,012,829 | 5/1991 | Thesing et al. | 131/344 |
| 5,107,863 | 4/1992 | Nyffeler et al. | 131/331 |
| 5,365,951 | 11/1994 | Arterbery et al. | 131/331 |
| 5,423,336 | 6/1995 | Mentzel et al. | 131/331 |

FOREIGN PATENT DOCUMENTS

| | | | |
|---|---|---|---|
| 1 211 481 | 11/1970 | United Kingdom | 131/331 |
| 2 236 239 | 1/1994 | United Kingdom | 131/331 |

*Primary Examiner*—Mickey Yu
*Assistant Examiner*—Charles W. Anderson
*Attorney, Agent, or Firm*—Flynn, Thiel, Boutell & Tanis, P.C.

[57] ABSTRACT

A ventilated cigarette filter having a tobacco smoke filtering core, a tubular body of air-permeable material around the core, and an outer wrapper engaged around the tubular body and providing in use for the lateral ingress of external air therethrough into the tubular body, the core comprising a plurality of longitudinally aligned plugs of which one is an unwrapped buccal end plug of material which is the same as or similar to that of the surrounding tubular body so as to give a substantially uniform or integral buccal end appearance.

20 Claims, 1 Drawing Sheet

CONCENTRIC CORE FILTER

FIELD OF THE INVENTION

The present invention relates to a ventilated cigarette filter of the type having a tobacco smoke filtering core, a tubular body of air-permeable material around the core, and an outer wrapper engaged around the tubular body and providing in use for the lateral ingress of external air there through into the tubular body.

BACKGROUND OF THE INVENTION

In such concentric core cigarette filters, it is usually preferred for the core and tubular body to be of different materials, but this can give an unacceptable and unsightly end appearance to the final filter cigarette product, and it is thus conventional for the concentric core filter to be employed in conjunction with a plain buccal end plug of acceptable uniform end appearance.

SUMMARY OF THE INVENTION

According to the present invention, the core of a concentric core filter comprises a plurality of longitudinally aligned plugs of which one is an unwrapped buccal end plug of material which is the same as or similar to that of the surrounding tubular body so as to give a substantially uniform or integral or unitary buccal end appearance—i.e. no boundary between core plug and tubular body is evident at the buccal end; this may be so even during or after smoking. The filter according to the invention thus provides the required desired end appearance without the use of a separate buccal end plug which extends over the full filter cross-section and which in the prior constructions tends to mask or dilute the desirable performance and characteristics provided by the concentric core construction.

Preferably, the buccal end core plug and the surrounding tubular body are of gathered and bonded cellulose acetate tow. It is not essential for the tows of the buccal end core plug and surrounding tubular body to be identical, it being possible to obtain a uniform buccal end appearance when the two tows differ, for example, in filament or tow denier.

The invention also provides a ventilated cigarette filter having a tobacco smoke filtering core comprising a plurality of longitudinally aligned plugs, a tubular body of air-permeable cellulose acetate tow around the core, and a ventilating outer wrapper engaged around the tubular body, one of the core plugs being a non-wrapped plug of cellulose acetate tow.

The choice of the core and tubular body components and the ventilation employed may be such that in use the majority of the smoke stream passes to the smokers mouth along the core and the majority of the ventilating air drawn in through the outer wrapper passes to the smokers mouth along the region between core and outer wrapper; this may be so even when smoke enters both core and tubular body at the upstream end, and is directed from tubular body to core by the ventilation further downstream.

The outer wrapper may be perforate and/or of air-permeable material to provide for the passage of ventilating air there through. The outer wrapper may be the tipping overwrap by means of which the filter is incorporated in a filter cigarette, in which case it will usually be of air-impermeable material with ventilating perforations therethrough; the filter will then be initially produced and supplied for filter cigarette manufacture as a rod without an outer wrapper, and the present invention also includes such unwrapped rods. Instead, the outer wrapper could be one applied during filter manufacture, and extend only the length of the filter; in such cases the filter might be incorporated in a filter cigarette by means of ring tipping or of a ventilating tipping overwrap. The present invention includes all of these types of filter cigarette.

The core plugs may be of any of a variety of tobacco smoke filtering materials. The buccal end plug, which is non-wrapped, is preferably of cellulose acetate tow, but could for example be of bonded or unbonded staple fibres or other filamentary tow (e.g. of polyolefin etc.), or smoke-permeable cellular material. The buccal end core plug is accompanied by at least one other plug in longitudinal alignment therewith; such other plug may be wrapped or non-wrapped and will usually be of different characteristics (e.g. pressure drop or filtering efficiency etc.) and/or composition from the buccal end plug; it could for example be of web material, preferably corrugated (e.g. cellulose acetate fibre or filamentary web or creped paper), or acetate tow, active acetate, or staple fibre and could contain particulate additive—preferably sorbent (e.g. activated carbon); it could consist substantially wholly of such sorbent e.g. as in GB-A-2236239. The core may extend wholly or only partially the length of the filter (leaving a recess at the upstream end), and adjacent plugs may abut or be longitudinally spaced.

The tubular body preferably adheres to or is adhered to one or more core plugs to resist separation in the composite product. Thus where the tubular body is to be formed by gathering solvent-plasticised filaments or fibres around the core, at least one core plug (or its surface) is suitably of material softened by the said plasticiser, so that plug and tubular body adhere as they are brought together; thus in the case of a tubular body of plasticised (e.g. by triacetin) cellulose acetate filaments or fibres, this will adhere to a buccal end core plug of cellulose acetate fibres or filaments, and/or to a wrapped upstream core plug if its wrapper is cellulose acetate film. The core and the material of the tubular body may in general be adhered together by any adhesive, applied to either or both before they are contacted.

The tubular body around the inner sleeve may also be of a variety of air-permeable materials—e.g.—bonded or unbonded staple fibres or filamentary tow (of cellulose acetate or polyolefin etc.) or of open cell plastics foam. It is preferably of cellulose acetate tow. It may be of material of greater inherent air-permeability than the core (and/or provided with grooves or passages), so as to be of relatively low pressure drop compared to the core, but the overall arrangement may still be such that in use the smoke stream is encouraged to travel to the smoker's mouth along the core in preference to the tubular body. Other embodiments are possible, however, with the tubular body having greater resistance to draw than the core.

The outer surface of the tubular body may be plain, or it may have one or more grooves therein extending longitudinally of the filter; such groove or grooves may extend from end to end of the tubular body or stop short of one or both ends. Such grooves help reduce the pressure drop of the tubular body and encourage concentration of the ventilation air in the region between the core and outer wrapper. Preferably at least some of the ventilating air passes through the outer wrapper directly into such a groove or grooves. The surface of the or each groove will generally be air-permeable.

Filter elements and filters according to the invention can be made by continuously advancing the aligned core plugs (e.g. through a hollow mandrel) with a continuous supply of air-permeable material therearound (e.g. around such hollow mandrel) to and through a tubular former to gather said air-permeable material into the tubular body around the core. If necessary or desired, a ventilating plugwrap may be continuously applied around the tubular body as or after the continuous composite rod is formed. Before any such wrapping, continuous or discontinuous longitudinal grooves or corrugations may be formed in the periphery of the tubular body. Where the grooves or corrugations are continuous, they may be produced as the tubular body is formed—e.g. by use of an appropriately contoured tubular former; if they are discontinuous, they will generally be impressed into the surface of the tubular body after formation of the composite rod. The continuously produced grooved or ungrooved, wrapped or unwrapped, composite rod can then be severed transversely into individual finite lengths. The initial severing usually results in rods of an even multiple (e.g. sextuple) length compared to that of the individual element incorporated in a filter cigarette; for filter cigarette manufacture a double length element, cut if necessary from an initially produced longer (e.g. sextuple length) rod, is disposed in abutting end to end contact between a pair of wrapped tobacco rods and joined thereto by ring tipping or ventilating tipping overwrap, and the resulting assembly is then cut through the double length filter to yield two filter cigarettes. It will be appreciated that where the individual filter element is asymmetric, with different buccal end and upstream core plugs, the initially produced multiple length rod will instead be symmetrical. This invention includes the initially produced multiple length filter elements and filter rods from which the individual elements and filters can be cut, and their production. The multiple length rods are thus individual filters or filter elements according to the invention integrally joined together in mirror image relationship.

The individual core plugs can readily be made using conventional commercial equipment with rod formers or garnitures of appropriately smaller diameter than is conventional for normal filter plugs. The plugs will usually be initially produced as continuous rods which are then cut to individual lengths. These cut lengths can be assembled to provide the continuous supply of core plugs using conventional handling equipment in precisely the same way as for the production of conventional dual or multiple plug filters. For the production of filters having two core plugs, the plugs would initially be cut to double their final lengths and assembled and supplied in conventional manner in longitudinal alignment with buccal end and tobacco end plugs alternating. The composite core and the material for the tubular body surrounding the core are supplied simultaneously to a garniture as described above to form the composite coaxial rod which if necessary is wrapped with a ventilating wrapper. The resulting continuous rod will usually be cut into even multiple (e.g. sextuple) length rods; the latter will then usually eventually be cut through the tobacco end core plugs to give double length rods each having a double length buccal end core plug between two single length tobacco end core plugs; the latter will be joined between two tobacco rods as described above and cut through the central buccal end core plug to give two filter cigarettes.

The core of filters according to the invention may have two or more core plugs, with any two adjacent plugs abutting or being longitudinally spaced. Suitably there is simply a buccal end plug which is preferably of non-wrapped cellulose acetate tow and a tobacco end plug which could have a permeable or impermeable wrapper and which may be of creped paper and which could have a content of particulate sorbent (e.g. activated carbon). The buccal end plug may be shorter (e.g. 5 to 11 mm) than the accompanying plug(s)—which may for example occupy 15 or 20 mm or more. The pressure drop of the buccal end core plug will usually be less than that of the accompanying core plug(s) and could for example be as little as 15%; or 20% of the latter.

In one type of filter according to the invention, the core consists of a buccal end plug of non-wrapped cellulose acetate tow of low total denier with an abutting tobacco end plug of wrapped active acetate tow; the surrounding tubular body is of cellulose acetate tow in a ventilating wrapper. In other embodiments the tobacco end plug is of cellulose acetate tow loaded with activated carbon, or is of creped paper which may also carry activated carbon. Another filter according to the invention has a triple component core with a carbon-loaded wrapped acetate plug between two shorter non-wrapped acetate plugs; the surrounding tubular body is of non-wrapped acetate or of acetate in a ventilating wrap.

The filter according to the invention and the corresponding filter element (said filter without an outer wrapper) are applicable to cigarettes in general, but especially for low tar or ultra low tar (ultralight) filter cigarettes (e.g. delivering 10 mg or less of tar).

BRIEF DESCRIPTION OF THE DRAWINGS

The invention is illustrated in the accompanying drawings, in which like reference numerals indicate like items. In the drawings, which are not to scale.

DETAILED DESCRIPTION

Figure 1:
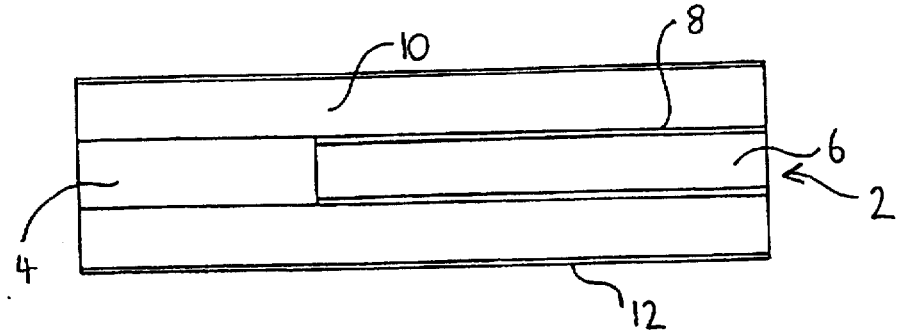
FIG. 1 is a diagrammatic longitudinal sectional view of a filter according to the invention.

The filter shown in FIG. 1 has a two-component core [2] made up of a buccal end filter plug [4] abutting a longer filter plug [6] of different composition; plug [6] may have a wrap [8] as shown, but could instead be unwrapped. In surrounding engagement with core [2] is a tubular air-permeable body [10] which may have a ventilating wrap [12] as shown or which may be unwrapped. Ventilating wrap [12] when present may be of inherently permeable material and/or provided with ventilating perforations, or it may be of any other known type of ventilating wrap - e.g. as in GB-A-2175187. The same applies to wrap [8] when it is present; alternatively, wrap [8] when present may be impermeable. Nonwrapped buccal end core component [4] and tubular body [10] are of the same or similar material so that no boundary between them is evident and the buccal end of the filter presents a plain uniform appearance.

Figure 2:
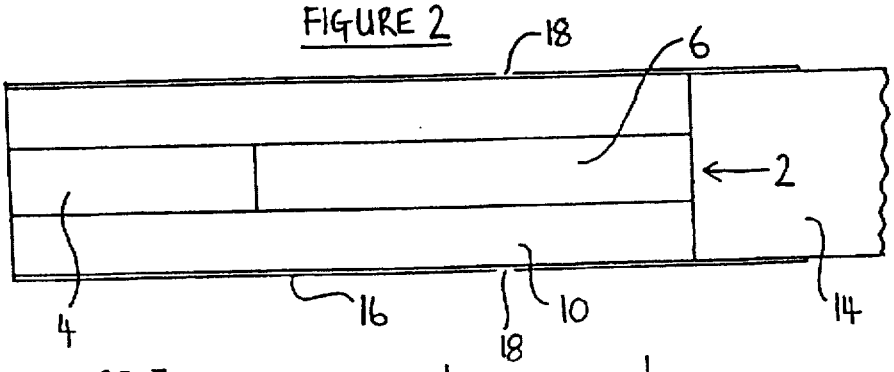
FIG. 2 is a similar view of a filter according to the invention incorporated in a filter cigarette.
Figure 4:
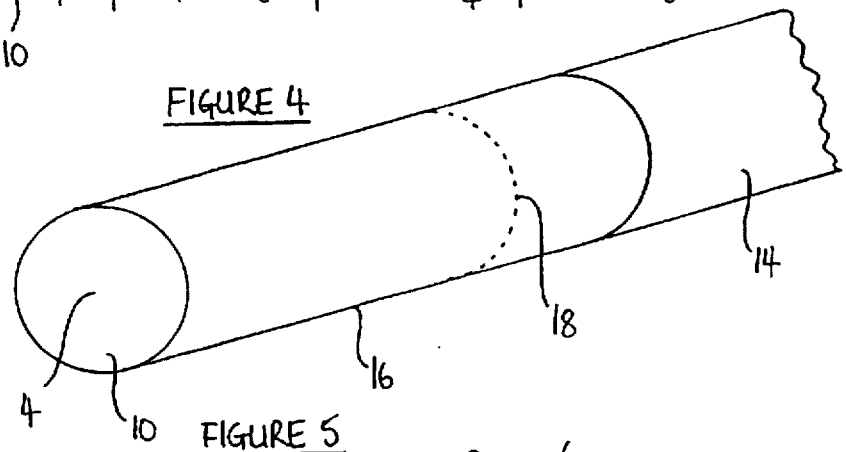
FIG. 4 is a schematic perspective view of the filter cigarette of FIG. 2.

FIGS. 2 and 4 show a filter similar to that of FIG. 1 attached to a wrapped tobacco rod [14] by a tipping overwrap [16] having a ring of ventilating perforations [18]. In FIG. 2 both core component [6] and tubular body [10] are non-wrapped, but wrap [8] and/or wrap [12] could be present as shown in FIG. 1. The compositions of the core components and tubular surround, and the extent and positioning of ventilation through tipping overwrap [16], are preferably selected so that, in use, the majority of the smoke stream passes to the buccal end along the core and the majority of the ventilating air passes to the buccal end through the tubular body.

The tubular body [10] preferably adheres to at least one of the core components, most preferably to buccal end plug [4]; this is conveniently accomplished by way of the plasticizer content of component [10] and/or [4].

Figure 3:
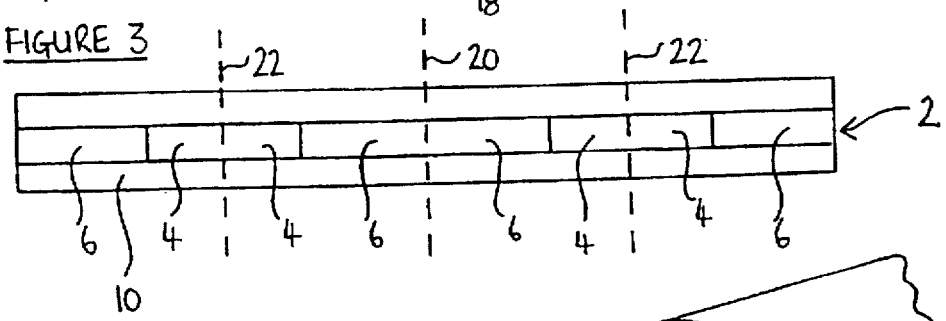
FIG. 3 is a similar view of a multiple length rod from which a filter according to the invention can be cut.

FIG. 3 shows a multiple length rod from which individual filters according to the invention can be cut. For the production of filters of the type shown in FIG. 2, a continuous stream of alternating abutting plugs [4] and [6] (each double its length as shown for the individual filter in FIG. 2) is advanced longitudinally and continuously provided with surrounding tubular body [10], and the resulting composite rod is cut, as it is continuously produced, into multiple length rods, this being the form in which the product is normally supplied to the filter cigarette manufacturer. FIG. 3 shows such a rod of quadruple length which has been cut to leave single length plugs [6] at each end. For use, this quadruple length rod would be cut at [20] to give two double length rods; a double length rod would then be sandwiched between two wrapped tobacco rods [14] and joined thereto by a double length tipping overwrap [18] with a cut then being made as indicated at [22] in FIG. 3 to give two filter cigarettes of the FIG. 2 type, each with single plugs [4] (buccal end) and [6] (tobacco end). In FIG. 3, components [6] and [10] are shown unwrapped, but either or both could be wrapped as for the FIG. 1 embodiment. It will be evident that for other variations (e.g. triple component cores, or cores with cavities etc.) the initially produced multiple length rod would be modified accordingly.

Figure 5:
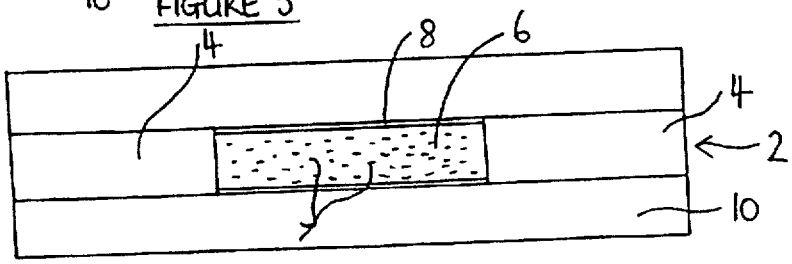
FIG. 5 is a view, similar to that of FIG. 1, of another filter according to the invention.

FIG. 5 shows a modification of the FIG. 1 filter, in which the core is made of three abutting plugs—a central plug [6] (which may incorporate particulate additive [7], for example particulate sorbent) between two non-wrapped plugs [4]. Other variations of the illustrated embodiments are possible—e.g. with plugs [4] and [6] spaced longitudinally to provide an internal cavity, or with plug [6] stopping short of the upstream end of the filter to provide a cavity at the upstream end. Another possible variation is for buccal end non-wrapped plug [4] to have a central cavity extending from its exposed end, this cavity being of circular or any more distinctive peripheral configuration; plug [4] may thus be tubular, or of the type disclosed in GB-A-1263154 and -1571114.

The following are specific Examples of filter rods according to the invention. In all cases, unless otherwise specified, the core is of about 16 mm circumference, and the filter is of about 24.5 mm circumference.

EXAMPLE 1

A filter as shown in FIG. 1 has a buccal end non-wrapped plug [4] of cellulose acetate filamentary tow of 5/17 denier—i.e. a denier per filament of 5 and a total tow denier of 17,000; this buccal end plug is 11 mm long and abuts a 16 mm long plug of active acetate filamentary tow in an impermeable wrap. The surrounding tubular body [10] is of 5/30 cellulose acetate tow in a conventional permeable plugwrap—porous paper of 500K permeability.

EXAMPLE 2

This embodiment is the same as that of Example 1 except that plug [6] is of wrapped 6.4/17 cellulose acetate tow loaded with SC2 activated carbon.

EXAMPLE 3

This embodiment is the same as that of Example 2 except that the tubular body is of 5/40 denier cellulose acetate tow, bonded to plug [4] by plasticizer from the plug and tubular body.

EXAMPLE 4 and 5

These embodiments are the same as those of Examples 2 and 3 respectively, except that plug [6] is of wrapped 140 mm 36 g TK semi-crepe paper (available from Tela Papierfabric AG of Switzerland) which may also carry activated carbon.

EXAMPLES 6 to 10

These are the same as Examples 1 to 5 respectively, except that buccal end plug [4] is 5 to 7 mm in length, with plug [6] being 20 mm or more long.

EXAMPLE 11

In this Example the core is of 17 mm circumference, and the filter is 25 mm long and of 24.3 mm circumference. The core is of triple construction with a central 13 mm long wrapped cellulose acetate tow plug carrying activated carbon abutted between two 6 mm long non-wrapped cellulose acetate tow plugs. The non-wrapped plugs [4] were of 5.4/17 denier tow, and the surrounding tubular body [10] was of 8/39 denier cellulose acetate tow. The pressure drop of the filter was 40 mm water gauge; in standard smoking tests, it gave a tar retention of 44% and a nicotine retention of 30%.

Details of specific filters according to Examples 2 to 5 are given in the following Table, in which TR and NR are tar and nicotine retentions respectively as measured by standard smoking test, C/V is coefficient of variation, and Wg is water gauge.

The filters and elements according to the invention, especially those illustrated or exemplified, are particularly effective when used with ultralight cigarettes using high ventilation levels—e.g. of 50–80t.

Although a particular preferred embodiment of the invention has been disclosed in detail for illustrative purposes, it will be recognized that variations or modifications of the disclosed apparatus, including the rearrangement of parts, lie within the scope of the present invention.

| | Core Material denier etc. | | | Approximate PD of core components mm. Wg. | | Rod Circumference mm. | | PD of multiple length rod mm. Wg. | | End Segment Length mm. | | | PD of single length filter mm. Wg. | | | |
|---|---|---|---|---|---|---|---|---|---|---|---|---|---|---|---|---|
| Example | Annulus Tow denier | Mouth End 11 mm | Tobacco End 16 mm | Mouth End | Tob. End | Mean | SD | Mean | C/V % | Mean | Min | Max | Mean | C/V % | TR % | NR % |
| 2 | 5/30 | 5/17 | 6.4/17 + SC2 | 40 | 64 | 24.38 | 0.050 | 297 | 5.4 | 16.17 | 15.0 | 17.6 | 72 | 6.7 | 44.1 | 37.8 |
| 3 | 5/40 | 5/17 | 6.4/17 + SC2 | 40 | 64 | 24.46 | 0.060 | 554 | 7.6 | 15.82 | 14.4 | 17.1 | 135 | 8.1 | 53.9 | 48.2 |

-continued

| Example | Core Material denier etc. Annulus Tow denier | Mouth End 11 mm | Tobacco End 16 mm | Approximate PD of core components mm. Wg. Mouth End | Tob. End | Rod Circumference mm. Mean | SD | PD of multiple length rod mm. Wg. Mean | C/V % | End Segment Length mm. Mean | Min | Max | PD of single length filter mm. Wg. Mean | C/V % | TR % | NR % |
|---|---|---|---|---|---|---|---|---|---|---|---|---|---|---|---|---|
| 4 | 5/30 | 5/17 | 140 mm 36 g TK | 40 | 249 | 24.48 | 0.100 | 530 | 11.0 | 16.30 | 13.9 | 18.8 | 136 | 11.6 | 60.5 | 57.4 |
| 5 | 5/40 | 5/17 | 140 mm 36 g TK | 40 | 249 | 24.61 | 0.050 | 880 | 5.2 | 15.83 | 14.0 | 17.3 | 225 | 11.6 | 72.4 | 68.8 |

We claim:

1. A ventilated cigarette filter for attachment to one end of a tobacco rod such that one end of said filter is visible, said filter comprising:

a tobacco smoke filtering core comprising a plurality of longitudinally aligned plugs;

a tubular body of air permeable material disposed about said core;

an outer wrapper disposed about said tubular body configured to permit flow of external air therethrough and into said tubular body;

a first one of said plugs being unwrapped and together with said tubular body defining said one visible end of said filter, said first plug being of a material similar to said material of said tubular body to provide a substantially uniform appearance to said one visible end of said filter; and a second one of said plugs being disposed axially adjacent said first plug and being of a material different in filtering capability than said material of said first plug.

2. The filter according to claim 1, wherein said second plug has a length substantially greater than a length of said first plug.

3. The filter according to claim 1, wherein said first plug and said tubular body comprise cellulose acetate tow and said second plug comprises gathered web material.

4. The filter according to claim 1, wherein said tubular body is adhered to at least one of said plurality of plugs.

5. The filter according to claim 1, wherein said tubular body comprises staple fibers, filamentary tow, or open cell plastics foam.

6. The filter according to claim 1, wherein said second plug comprises a wrapped or unwrapped plug of gathered web material, staple fiber material, or tow material.

7. The filter according to claim 1, wherein said second plug comprises particulate sorbent.

8. A ventilated cigarette filter for attachment to one end of a tobacco rod such that one end of said filter is visible, said filter comprising:

a tobacco smoke filtering core comprising a plurality of longitudinally aligned plugs;

a tubular body of air permeable material disposed about said core;

a first one of said plugs being unwrapped and together with said tubular body defining said one visible end of said filter, said first plug being of a material similar to said material of said tubular body to provide a substantially uniform and integral appearance to said one visible end of said filter; and a second one of said plugs being disposed axially adjacent said first plug and being of a material different in filtering capability or pressure drop than said material of said first plug.

9. The filter according to claim 8, wherein said second plug has a length substantially greater than a length of said first plug.

10. The filter according to claim 8, wherein said first plug and said tubular body comprise cellulose acetate tow and said second plug comprises gathered web material.

11. The filter according to claim 8, wherein said tubular body is adhered to at least one of said plurality of plugs and comprises staple fibers, filamentary tow, or open cell plastics foam.

12. The filter according to claim 8, wherein said second plug comprises a wrapped or unwrapped plug of gathered web material, tow material or staple fiber material.

13. The filter according to claim 8, wherein said second plug comprises particulate sorbent.

14. A cigarette comprising:

a tobacco rod;

a filter attached to one end of said tobacco rod such that one end of said filter is visible, said filter comprising:

a tobacco smoke filtering core comprising a plurality of longitudinally aligned plugs; and a tubular body of air permeable material disposed about said core;

an outer wrapper disposed about said filter and said tobacco rod configured to permit flow of external air therethrough and into said tubular body of said filter;

a first one of said plugs being unwrapped and together with said tubular body defining said visible end of said filter, said first plug being of a material similar to said material of said tubular body to provide a substantially uniform appearance to said one visible end of said filter; and a second one of said plugs being disposed axially adjacent said first plug and being of a material different in filtering capability than said material of said first plug.

15. The cigarette according to claim 14, wherein said second plug has a length substantially greater than a length of said first plug.

16. The cigarette according to claim 14, wherein said first plug and said tubular body comprise cellulose acetate tow.

17. The cigarette according to claim 14, wherein said second plug comprises particulate sorbent.

18. The cigarette according to claim 14, wherein said second plug comprises a wrapped or unwrapped plug of gathered web material, tow material or staple fiber material.

19. The cigarette according to claim 14, wherein said tubular body comprises staple fibers, filamentary tow, or open cell plastics foam.

20. The cigarette according to claim 14, wherein said tubular body is adhered to at least one of said plurality of plugs.

* * * * *